US007733304B2

(12) United States Patent
Jeong et al.

(10) Patent No.: US 7,733,304 B2
(45) Date of Patent: Jun. 8, 2010

(54) PLASMA DISPLAY AND PLASMA DISPLAY DRIVER AND METHOD OF DRIVING PLASMA DISPLAY

(75) Inventors: Seong-Joon Jeong, Chunan-si (KR); Jin-Ho Yang, Chunan-si (KR); Woo-Joon Chung, Chunan-si (KR); Tae-Seong Kim, Chunan-si (KR); Suk-Jae Park, Chunan-si (KR); Seung-Min Kim, Chunan-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 1007 days.

(21) Appl. No.: 11/480,445

(22) Filed: Jul. 5, 2006

(65) Prior Publication Data

US 2007/0029942 A1 Feb. 8, 2007

(30) Foreign Application Priority Data

Aug. 2, 2005 (KR) ..... 10-2005-0070768
Aug. 16, 2005 (KR) ..... 10-2005-0074778

(51) Int. Cl.
*G09G 3/28* (2006.01)

(52) U.S. Cl. ..... 345/66; 345/60; 315/169.4

(58) Field of Classification Search ..... 345/60–86, 345/204–214, 690–697; 315/169.3, 169.4; 313/567–643

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,952,782 A 9/1999 Nanto (Continued)

FOREIGN PATENT DOCUMENTS

CN 1499464 5/2004

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—David L Lewis
(74) *Attorney, Agent, or Firm*—Robert E. Bushnell, Esq.

(57) ABSTRACT

A plasma display includes a plurality of scan electrodes. A scan voltage is sequentially supplied to the plurality of scan electrodes, and a non-scan voltage that is higher than the scan voltage is supplied to scan electrodes to which the scan voltage is supplied. The non-scan voltage is generated by dividing a voltage that is higher than the non-scan voltage and the scan voltage. Thus, a voltage source for supplying the non-scan voltage can be eliminated.

25 Claims, 8 Drawing Sheets

U.S. PATENT DOCUMENTS

| | | | | |
|---|---|---|---|---|
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,242,373 | B2 * | 7/2007 | Tomio et al. | 345/60 |
| 7,483,000 | B2 * | 1/2009 | Lee et al. | 345/60 |
| 2003/0117388 | A1 | 6/2003 | Koyama | |
| 2004/0012547 | A1 | 1/2004 | Lee | |
| 2005/0110709 | A1 | 5/2005 | Lee | |
| 2005/0134531 | A1 * | 6/2005 | Onozawa et al. | 345/60 |

FOREIGN PATENT DOCUMENTS

| | | |
|---|---|---|
| CN | 1523555 | 8/2004 |
| CN | 1617197 | 5/2005 |
| EP | 1193673 | 4/2002 |
| EP | 1341147 | 9/2003 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY AND PLASMA DISPLAY DRIVER AND METHOD OF DRIVING PLASMA DISPLAY

CLAIM OF PRIORITY

This applications makes reference to, incorporates the same herein, and claims all benefits accruing under 35 U.S.C. §119 from two applications for PLASMA DISPLAY AND DRIVING DEVICE AND METHOD THEREOF earlier filed in the Korean Intellectual Property Office on the $2^{nd}$ of Aug. 2005 and the $16^{th}$ of Aug. 2005 and there, duly assigned Serial Nos. 10-2005-0070768 and 10-2005-0074778, respectively.

BACKGROUND OF THE INVENTION

1. Field of the Invention

The present invention relates to a plasma display, a plasma display driver, and a method of driving a plasma display, and more particularly, to a driving circuit for driving a scan electrode of the plasma display.

2. Description of the Related Art

A plasma display is a display device that uses a plasma generated by gas discharge in discharge cells to display characters to images. Depending on its size, a Plasma Display Panel (PDP) of the plasma display includes more than several tens to millions of pixels arranged in a matrix pattern.

One frame of the plasma display is divided into a plurality of subfields. Each subfield has a brightness weight and includes a reset period, an address period, and a sustain period. The reset period is for initializing the status of each discharge cell. The address period is for selecting turned-on/turned-off cells among the discharge cells, and the sustain period is for causing the turned-on cells to continue to discharge for displaying an image.

In the plasma display, a discharge can be generated between two electrodes when a voltage difference between the two electrodes is greater than a predetermined voltage. Recently, the tendency has been to lower discharge voltages by using negative voltages since the discharge voltages are too high if all of the discharge voltages are set to positive voltages. Then, the discharge voltages can be lowered by using the negative voltages, but the number of voltage sources increase since the voltages of the reset period, the address period, and the sustain period are different.

SUMMARY OF THE INVENTION

The present invention provides a plasma display and a plasma display driver and a method of driving the plasma display that reduce the number of voltage sources.

An exemplary embodiment of the present invention is a plasma display including: a plurality of scan electrodes; a plurality of scan circuits respectively coupled to the plurality of scan electrodes, each scan circuit adapted to selectively supply a voltage of a first node and a voltage of a second node to a corresponding scan electrode of the plurality of scan electrodes; a capacitor coupled between the first node and the second node; a first transistor coupled between the second node and a first voltage source adapted to supply a first voltage; a second transistor coupled between a second voltage source adapted to supply a second voltage and the first node, and having a source whose voltage is determined by the first node; a first resistor coupled between the second voltage source and a gate of the second transistor; and a second resistor coupled to the gate of the second transistor, and adapted to divide the second voltage together with the first resistor.

The second resistor is preferably coupled between the gate of the second transistor and a third voltage source.

The third voltage source preferably includes the first voltage source.

The second resistor is preferably coupled between the gate of the second transistor and the source of the second transistor.

The second transistor is preferably an n-channel transistor, and the second voltage is preferably higher than the first voltage.

The first voltage is a preferably negative voltage, and the second voltage is preferably a ground voltage.

At least one of the first resistor and the second resistor preferably includes a variable resistor.

The plasma display preferably further includes a diode and a third resistor coupled in series between the second voltage source and a drain of the second transistor; the first resistor is coupled between a contact point of the diode and the third resistor and the gate of the second transistor.

Each scan circuit preferably includes: a third transistor coupled between the first node and the corresponding scan electrode; and a fourth transistor coupled between the corresponding scan electrode and the second node.

The first transistor is preferably turned on, the fourth transistors of the plurality of scan circuits are preferably selectively turned on, and the third transistors of scan circuits having the turned-off fourth transistors are preferably turned on during the address period.

At least part of the plurality of scan circuits preferably include an integrated circuit.

Another exemplary embodiment of the present invention is a method of driving a plasma display including a plurality of scan electrodes, a plurality of scan circuits respectively coupled to the plurality of scan electrodes, and a capacitor coupled between the first terminal and the second terminal, each scan circuit selectively supplying a voltage of a first terminal and a voltage of a second terminal to a corresponding scan electrode of the plurality of scan electrodes, the driving method including: supplying a first voltage to the second terminal; supplying a second voltage that is higher than the first voltage to the first terminal to charge the capacitor; electrically isolating the second voltage from the capacitor upon the capacitor being charged such that a voltage of the first terminal is a third voltage; and selectively supplying the third voltage and the first voltage to the plurality of scan electrodes through the first terminals and the second terminals of the plurality of scan circuits.

The second voltage is preferably higher than the third voltage. The first voltage is preferably a negative voltage, and the second voltage is preferably a ground voltage.

Supplying the third voltage and the first voltage to the plurality of scan electrodes preferably includes: sequentially supplying the first voltage to the plurality of scan electrodes; and supplying the third voltage to those scan electrodes which the first voltage have not been supplied.

Supplying the first voltage to the second terminal preferably includes supplying a voltage that is divided between a fourth voltage corresponding to the second voltage and the first voltage to a gate of a transistor having a source coupled to the first terminal; supplying the second voltage to the first terminal preferably includes turning on the transistor; and electrically isolating the second voltage from the capacitor preferably includes turning off the transistor.

Supplying the first voltage to the second terminal preferably includes supplying a voltage that is divided between a fourth voltage corresponding to the second voltage and a voltage of the first terminal to a gate of a transistor having a source coupled to the first terminal; supplying the second voltage to the first terminal preferably includes turning on the transistor; and electrically isolating the second voltage from the capacitor preferably includes turning off the transistor.

Still another exemplary embodiment of the present invention is plasma display driver for a plasma display including a plurality of scan electrodes and a plurality of scan circuits respectively coupled to the plurality of scan electrodes, each scan circuit selectively supplying a voltage of a first terminal and a voltage of a second terminal to a corresponding scan electrode of the plurality of scan electrodes, the plasma display driver including: a capacitor coupled between the first terminal and the second terminal; a first transistor coupled between the second terminal and a first voltage source and adapted to supply a first voltage; and a voltage divider coupled between the first voltage source and a second voltage source and adapted to supply a second voltage, and to output a third voltage that is lower than the second voltage to the first terminal.

The voltage divider preferably includes: a second transistor having a source coupled to the first terminal and a drain coupled to the second voltage source; a first resistor coupled between a gate of the second transistor and the drain of the second transistor; and a second resistor coupled between the gate of the second transistor and a source of the first transistor.

The first transistor is preferably adapted to be turned on during an address period.

The first voltage is a negative voltage, and the second voltage is a ground voltage.

Yet another exemplary embodiment of the present invention is a plasma display driver for a plasma display including a plurality of scan electrodes and a plurality of scan circuits respectively coupled to the plurality of scan electrodes, each scan circuit selectively supplying a voltage of a first terminal and a voltage of a second terminal to a corresponding scan electrode of the plurality of scan electrodes, the plasma display driver including: a capacitor coupled between the first terminal and the second terminal; a first transistor coupled between the second terminal and a first voltage source and adapted to supply a first voltage; and a linear regulator coupled between the first terminal and a second voltage source and adapted to supply a second voltage, and to output a third voltage that is lower than the second voltage to the first terminal.

The linear regulator preferably includes: a second transistor having a source coupled to the first terminal and a drain coupled to the second voltage source; a first resistor coupled between a gate of the second transistor and the drain of the second transistor; and a second resistor coupled between the gate of the second transistor and the source of the second transistor.

The first transistor is preferably adapted to be turned on during an address period.

The first voltage is preferably a negative voltage, and the second voltage is preferably a ground voltage.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
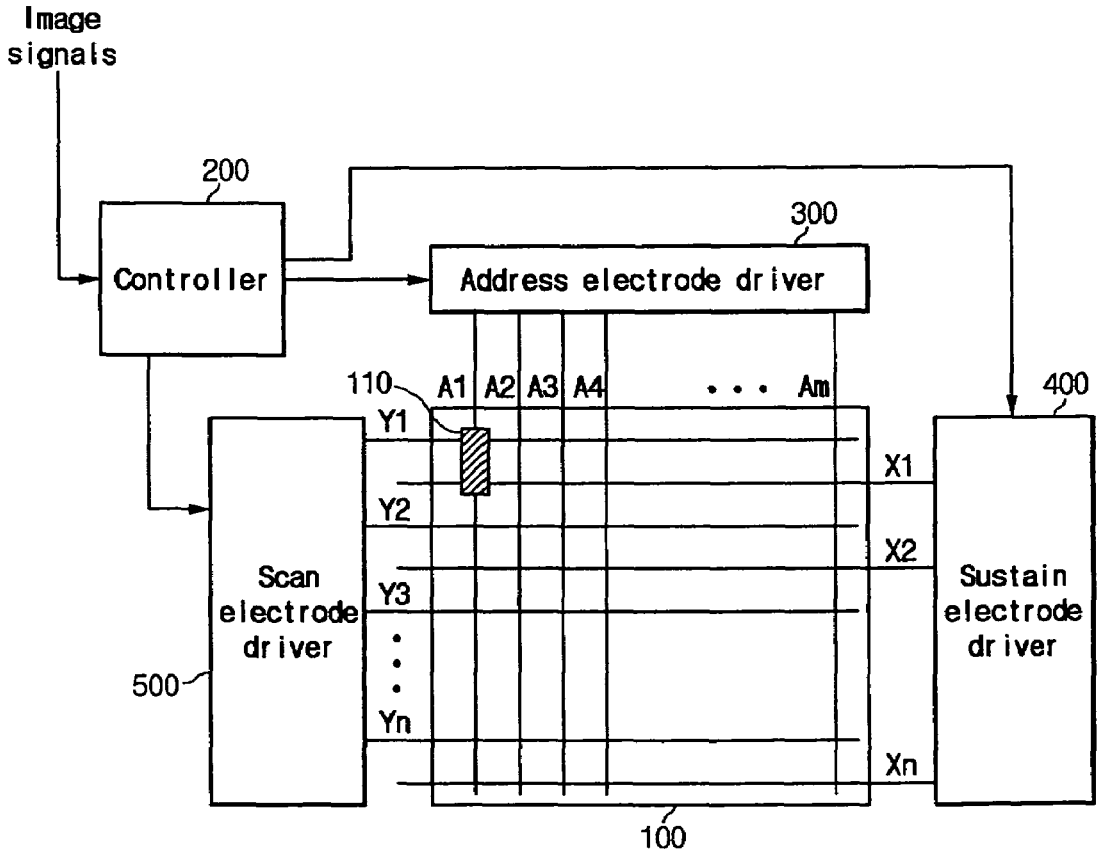
FIG. 1 is a view of a plasma display according to an exemplary embodiment of the present invention.

In the following detailed description, only certain exemplary embodiments of the present invention are shown and described, simply by way of illustration. As those skilled in the art would realize, the described embodiments can be modified in various different ways, all without departing from the spirit or scope of the present invention.

Accordingly, the drawings and description are to be regarded as illustrative in nature, and not restrictive. There may be parts shown in the drawings, or parts not shown in the drawings, that are not discussed in the specification as they are not essential to a complete understanding of the present invention. Like reference numerals designate like elements. Phrases such as "one thing is coupled to another" can refer to either "a first one is directly coupled to a second one" or "the first one is coupled to the second one with a third one provided therebetween".

Wall charges described in the present invention refer to charges formed on a wall of a discharge cell close to each electrode and accumulated on the electrode. The wall charge is described as being "formed" or "accumulated" on the electrode although the wall charges do not actually touch the electrodes. Furthermore, a wall voltage is a potential difference formed between the walls of the discharge cell by the wall charges.

FIG. 1 is a view of a plasma display according to an exemplary embodiment of the present invention.

As shown in FIG. 1, the plasma display includes a Plasma Display Panel (PDP) 100, a controller 200, an address electrode driver (hereinafter referred to as an "A electrode driver") 300, a sustain electrode driver (hereinafter referred to as an "X electrode driver") 400, and a scan electrode driver (hereinafter referred to as a "Y electrode driver") 500.

The PDP 100 include a plurality of address electrodes $A_1$ to $A_m$ (hereinafter referred to as "A electrodes") extending in a column direction, and a plurality of scan electrodes $Y_1$ to $Y_n$ and a plurality of sustain electrodes $X_1$ to $X_n$ (hereinafter respectively referred to as "Y electrodes" and "X electrodes"), each extending in a row direction. Generally, the respective X electrodes $X_1$ to $X_n$ correspond to the respective Y electrodes $Y_1$ and $Y_n$. The sub-pixel area delineating a discharge space where the A electrodes cross the Y and X electrodes forms a discharge cell (hereinafter referred to as a "cell") 110.

The controller 200 receives an external image signal and outputs driving control signals. The controller 200 divides a frame into a plurality of subfields having brightness weights. The A electrode driver 300, the X electrode driver 400, and the Y electrode driver 500 respectively supply driving voltages to the A electrodes $A_1$ to $A_m$, the X electrodes $X_1$ and $X_n$, and the Y electrodes $Y_1$ to $Y_n$ according to the driving control signals.

Figure 2:
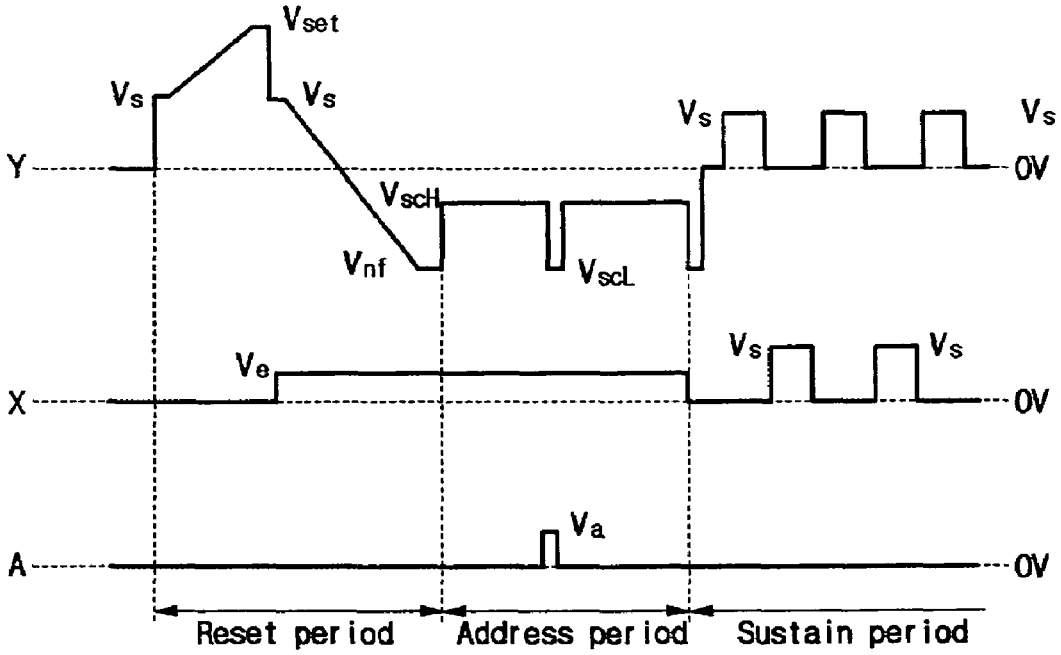
FIG. 2 are driving waveforms of the plasma display according to the exemplary embodiment of the present invention.

FIG. 2 are driving waveforms of the plasma display according to the exemplary embodiment of the present invention. In FIG. 2, one subfield of the plurality of subfields is exemplarily described. For convenience, the driving waveforms supplied to a Y electrode, an X electrode, and an A electrode are exemplarily described in connection with only one cell 110 (FIG. 1).

As shown, one subfield is divided into the rest period, the address period, and the sustain period. During the reset period, the Y electrode driver 500 gradually increases a Y electrode voltage from a voltage $V_s$ to a voltage $V_{set}$, while the A and X electrode drivers 300 and 400 respectively supply a ground voltage 0V to the A and X electrodes. As the Y electrode voltage is increased, a weak discharge is generated between the Y and X electrodes and between Y and A electrodes, and (−) wall charges are formed on the Y electrode and (+) wall charges are formed on the X and A electrodes.

Subsequently, the Y electrode driver 500 gradually reduces the Y electrode voltage from the voltage $V_s$ to a voltage $V_{nf}$ while the X electrode driver 400 supplies a voltage $V_e$ to the X electrode, and an A electrode voltage is maintained at the ground voltage 0V. Then, a weak discharge is generated between the Y and X electrodes and between the Y and A electrodes while the voltage of the Y electrode is reduced, and accordingly the (−) wall charges formed on the Y electrode and the (+) wall charges formed on the X and A electrodes are eliminated. As a result, the wall charges formed on the cell can be initialized.

While it has been described that the cell is initialized by gradually reducing the Y electrode voltage after gradually increasing the Y electrode in the reset period of FIG. 2, the cell may be initialized by another reset method.

During the address period, the Y and A electrode drivers 500 and 300 respectively supply a scan pulse of a voltage $V_{scL}$ and an address pulse of a voltage $V_a$ to the Y electrode and the A electrode to select the turned-on cell. Then, a discharge is generated in the cell receiving the scan pulse and the address pulse, and accordingly, the cell accumulates the wall charges to be set to the turned-on cell. In addition, the Y electrode driver 500 supplies a voltage $V_{scH}$ that is higher than the voltage $V_{scL}$ to a non-scanned Y electrode, and the A electrode driver 300 supplies the ground voltage 0V to a non-selected A electrode. The voltage $V_{scH}$ and the voltage $V_{scL}$ can be negative voltages.

In more detail, the Y electrode driver 500 supplies the scan pulse to the Y electrode in the first row ($Y_1$ of FIG. 1). At the same time, the A electrode driver 300 supplies the address pulse to the A electrode on the cells to be turned on along the first row. Then, after a discharge is generated between the Y electrode in the first row ($Y_1$) and the A electrode receiving the address pulse, a discharge is generated between the Y electrode and the X electrode. Accordingly, (+) wall charges are formed on the Y electrode and (−) wall charges are formed on the A and X electrodes. Subsequently, while the Y electrode driver 500 supplies the scan pulse to the Y electrode in a second row ($Y_2$ of FIG. 1), the A electrode driver 300 supplies the address pulse to the A electrodes on the cells to be turned on along the second row. Then, the address discharge is generated in the cells crossed by the A electrodes receiving the address pulse and the Y electrode in the second row ($Y_2$), and accordingly wall charges are formed in those cells in the manner described above. Regarding Y electrodes in other rows, wall charges are formed in cells to be turned on in the same manner as described above, i.e., by supplying the address pulse to A electrodes on cells to be turned on while sequentially supplying the scan pulse to the Y electrodes from the first row ($Y_1$ of FIG. 1) to the last row ($Y_n$ of FIG. 1).

During the sustain period, the Y and X electrode drivers 500 and 400 respectively supply a pulse of the voltage $V_s$ and the ground voltage 0V to the Y and X electrodes, since the wall potential of the Y electrode is higher than the X electrode in the cells (the turned-on cells) having undergone the address discharge in the address period. As a result, a sustain discharge is generated between the Y and X electrodes of the turned-on cells. By the sustain discharge, the (−) wall charges are formed on the Y electrode and the (+) wall charges are formed on the X and A electrodes, such that the wall potential of the X electrode is higher than that of the Y electrode.

Subsequently, the Y and X electrode drivers 500 and 400 respectively supply the ground voltage 0V and the pulse of the voltage $V_s$ to the Y and X electrodes, such that a subsequent sustain discharge is generated. As a result of this discharge, (+) wall charges are again formed on the Y electrode and (−) wall charges are again formed on the X and A electrodes such that another sustain discharge can be generated by supplying the voltage $V_s$ to the Y electrode.

The process of alternately supplying the pulse of the voltage $V_s$ to the Y electrode and supplying the pulse of the voltage $V_s$ is repeated a number of times corresponding to a weight of a corresponding subfield.

While the above exemplary embodiment has been described to supply the sustain pulse of the voltage $V_s$ to the Y electrode and the X electrode in turn, a pulse that causes a voltage difference between the Y and X electrodes to be the voltage $V_s$ and the voltage $-V_s$ in turn can be supplied to the Y electrode and/or the X electrode.

In addition, while the above exemplary embodiment has been described to set a cell to be the turned-on cell through the address discharge in the address period after erasing the wall charges to initialize the cell in the reset period, the cell can be set to be the turned-off cell through the address discharge in the address period after the cell accumulates the wall charges to be set to the turned-on cell in the reset period.

Next, a driving circuit for generating a driving waveform, selected from among the driving waveforms of FIG. 2, which is supplied to the Y electrode during the address period, is described below with reference to FIGS. 3 to 8.

Figure 3:
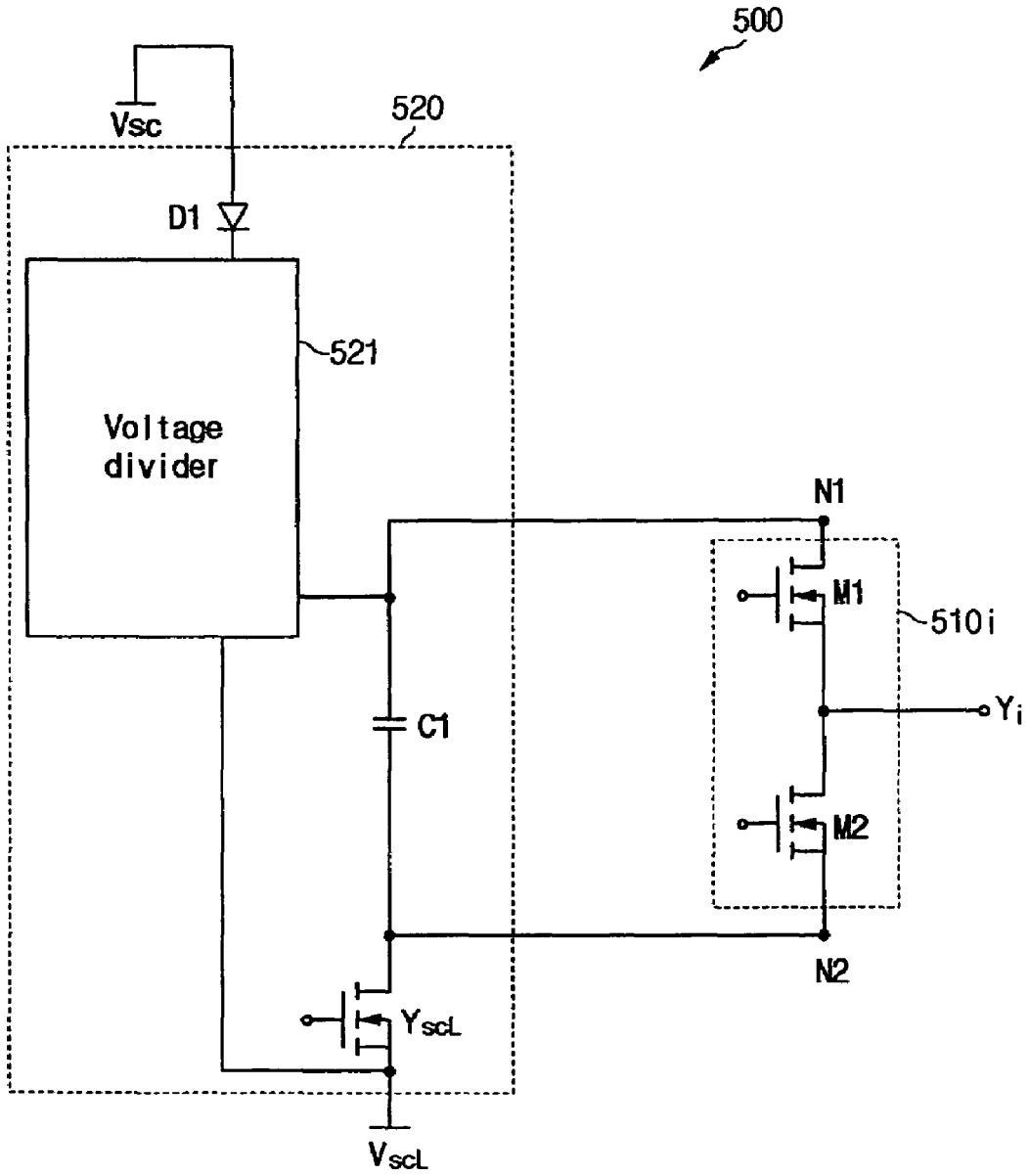
FIGS. 3, 4, 6, and 7 are respective circuit diagrams of Y electrode drivers according to first to fourth exemplary embodiments of the present invention.

FIG. 3 is a circuit diagram of the Y electrode driver 500 according to the first exemplary embodiment of the present invention. In FIG. 3, a switch is depicted as an n-channel field effect transistor, but any other switch performing a similar function to that described below can be used instead of the n-channel field effect transistor. In addition, a gate driver for driving a gate of a transistor is not shown in FIG. 3. Furthermore, a circuit for supplying the reset waveform to the Y electrode in the reset period and a circuit for supplying the sustain pulse to the Y electrode in the sustain period are not shown, and these circuits are generally coupled to a node N2 of FIG. 3.

As shown in FIG. 3, the Y electrode driver 500 includes a plurality of scan circuits $\mathbf{510}_1$ to $\mathbf{510}_n$ respectively coupled to the plurality of Y electrodes $Y_1$ to $Y_n$, and a scan driving circuit 520. For convenience of illustration, a $i^{th}$ scan circuit $\mathbf{510}_i$ coupled to a $i^{th}$ Y electrode are only shown in FIG. 3.

Each scan circuit $\mathbf{510}_i$ is coupled between a first node N1 and a second node N2, and includes two transistors M1 and M2. A contact point of the two transistors M1 and M2 is coupled to a corresponding Y electrode $Y_i$. In more detail, a source of the non-scan transistor M1 and a drain of the scan transistor M2 are coupled to the Y electrode $Y_i$. A drain of the non-scan transistor M1 of the scan circuit $\mathbf{510}_i$ is coupled to the first node N1, and a source of the scan transistor M2 of the scan circuit $\mathbf{510}_i$ is coupled to the second node N2. Generally, k scan circuits corresponding to k Y electrodes of the plurality of Y electrodes $Y_1$ to $Y_n$ are fabricated as a scan integrated circuit (where 'k' is less than 'n'), and output terminals of the scan integrated circuit are respectively coupled to the k Y electrodes. If the number of the output terminals of the scan integrated circuit is less than 'n', a plurality of scan integrated circuits can be used while being coupled in parallel. The first node N1 and the second node N2 become input terminals of the scan integrated circuits.

The scan driving circuit 520 includes a capacitor C1, a transistor $Y_{scL}$, and a voltage divider 521. In detail, a first terminal of the capacitor C1 is coupled to the first node N1 of the scan circuits $\mathbf{510}_1$ to $\mathbf{510}_n$, and a second terminal of the capacitor C1 is coupled to the second node N2 of the scan circuits $\mathbf{510}_1$ to $\mathbf{510}_n$. A drain of the transistor $Y_{scL}$ is coupled to the second node N2 of the scan circuits $\mathbf{510}_1$ to $\mathbf{510}_n$, and a source of the transistor $Y_{scL}$ is coupled to a voltage source for supplying a voltage $V_{scL}$.

The voltage driver 521 has an output terminal coupled to the first terminal N1 of the capacitor, and divides a voltage of a voltage source $V_{sc}$ and the voltage of the voltage source $V_{scL}$ and outputs a divided voltage to the output terminal. The voltage of the voltage source $V_{sc}$ is higher than the voltage $V_{scL}$. A diode D1 can be coupled between the voltage source $V_{sc}$ and the voltage divider 521 to block a current path which is formed from the voltage driver 521 to the voltage source $V_{sc}$.

The Y electrode driver 500 according to a second exemplary embodiment of the present invention is described below with reference to FIG. 4 and FIG. 5.

Figure 4:
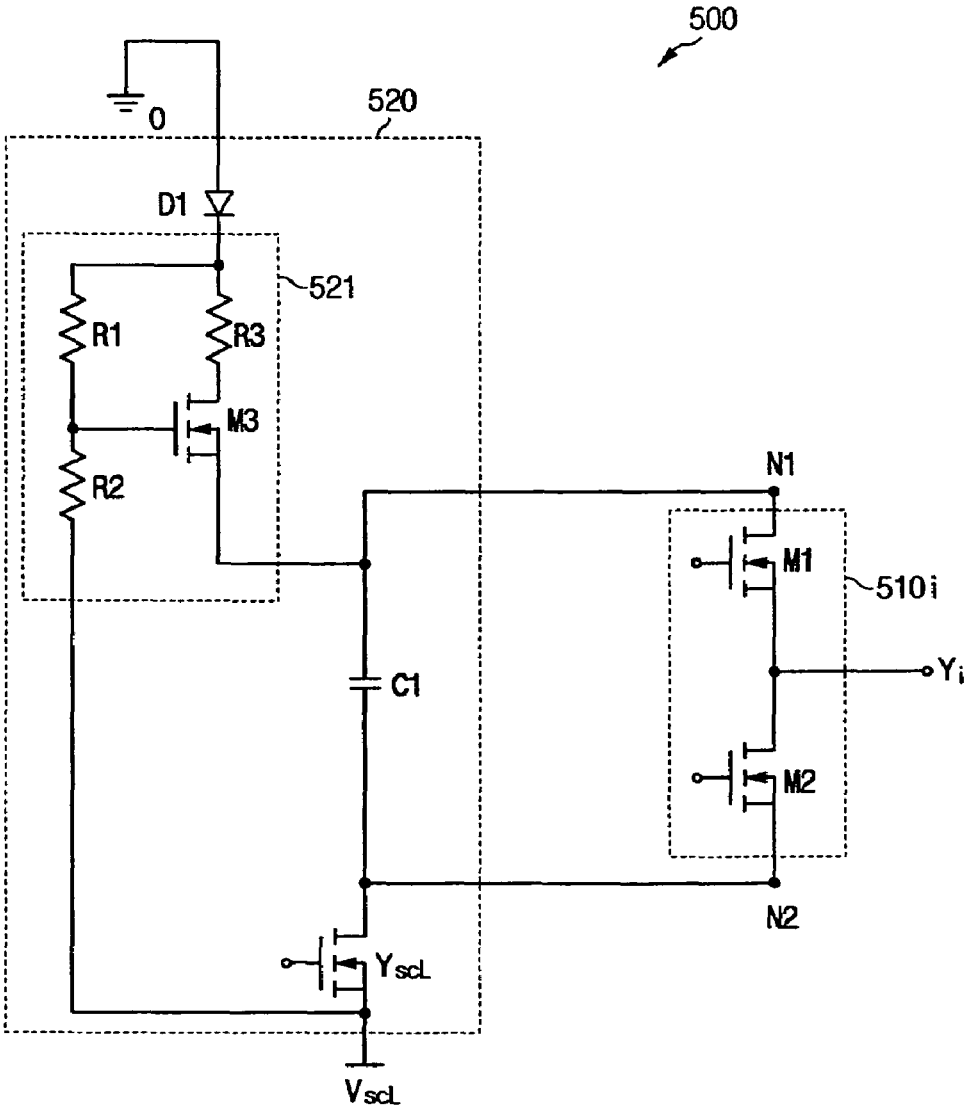
Figure 5:
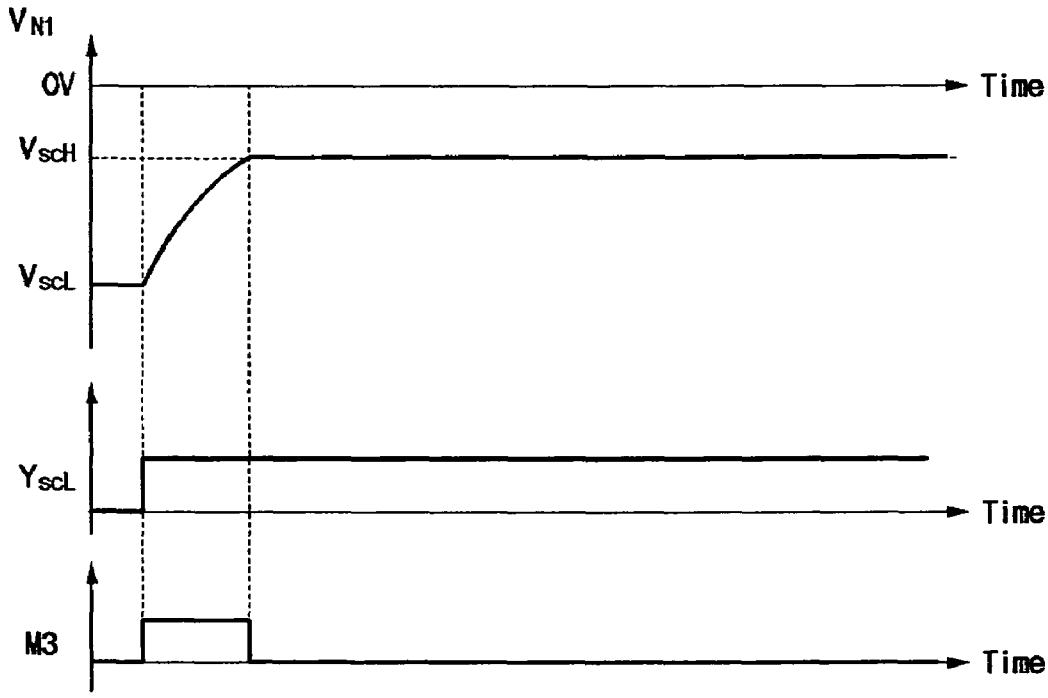
FIGS. 5 and 8 are respective waveforms of the driving circuits of FIGS. 4 and 7.

FIG. 4 is a circuit diagram of the Y electrode driver 500 according to the second exemplary embodiment, and FIG. 5 are waveforms of the driving circuit of FIG. 4. A ground terminal 0 is used as the voltage source $V_{sc}$ in FIG. 4. In FIG. 5, a high level corresponds to a turned-on state of a transistor, and a low level corresponds to a turned-off state of the transistor.

As shown in FIG. 4, a voltage divider 521' includes resistors R1 and R2, and a transistor M3, in the second exemplary embodiment. A source of the transistor M3 is coupled to the first terminal of N1 of the capacitor C1, and a drain of the transistor M3 is coupled to the ground terminal 0. The resistor R1 is coupled between a gate of the transistor M3 and the drain of the transistor M3, and the resistor R2 is coupled between a source of the transistor $Y_{scL}$ and the gate of the transistor M3. In addition, a resistor R3 can be coupled between the ground terminal 0 and the drain of the transistor M3 to limit current flowing from the drain to the source of the transistor M3.

Referring to FIG. 5, firstly, the transistor $Y_{scL}$ is turned on during the address period such that a voltage of the second terminal N2 of the capacitor C1 becomes the voltage $V_{scL}$. The ground voltage 0V and the voltage $V_{scL}$ are divided by the resistors R1 and R2 to be a gate voltage Vg of the transistor M3 as expressed in Equation 1 below. In addition, a source voltage of the transistor M3 becomes the voltage $V_{scL}$ since a voltage of the first terminal N1 of the capacitor C1 becomes the voltage $V_{scL}$ when a voltage has not been charged to the capacitor C1. Therefore, a gate-source voltage Vgs of the transistor M3 is expressed in Equation 2 below. Then, the transistor M3 is turned on by the positive gate-source voltage Vgs since the transistor M3 is an n-channel transistor. As a result, the capacitor C1 is charged through a path of the ground terminal 0, the diode D1, the resistor R3, the transistor M3, the capacitor C1, the transistor $Y_{scL}$, and the voltage source $V_{scL}$.

Equation 1:

$$Vg = \frac{R2}{R1 + R2}|VscL|$$

Equation 2:

$$Vgs = \left(1 + \frac{R2}{R1 + R2}\right)|VscL|$$

When the capacitor C1 is charged such that the gate-source voltage Vgs of the transistor M3 is less than a threshold voltage $V_{TH}$ of the transistor M3 as expressed in Equation 3, the transistor M3 is turned off. As a result, the voltage $V_{N1}$ of the first terminal N1 of the capacitor C1 as expressed in Equation 4, and this voltage $V_{N1}$ becomes the voltage $V_{scH}$. If the voltage $V_{N1}$ of the first terminal N1 of the capacitor C1 is lowered by discharge of the capacitor C1, the transistor M3 is turned on again. Therefore, a voltage charged to the capacitor C1 can be maintained at a desired voltage during the address period in which the transistor $Y_{scL}$ is turned on.

Equation 3:

$$Vgs = \frac{R2}{R1 + R2}|VscL| - V_{N1} < V_{TH}$$

Equation 4:

$$V_{N1} = VscH\frac{R2}{R1 + R2}|VscL| - V_{TH}$$

A time in which the capacitor C1 is charged can be determined by controlling a magnitude of the resistor R3. In addition, a magnitude of the voltage $V_{scH}$ can be determined by having at least one of the resistors R1 and R2 be a variable resistor and controlling a magnitude of the variable resistor.

As described above, while the first and second exemplary embodiments have been described as generating the voltage $V_{scH}$ by dividing the voltage $V_{sc}$ and the voltage $V_{scL}$, another circuit can be used to generate the voltage $V_{scH}$ instead of the voltage divider.

Figure 6:
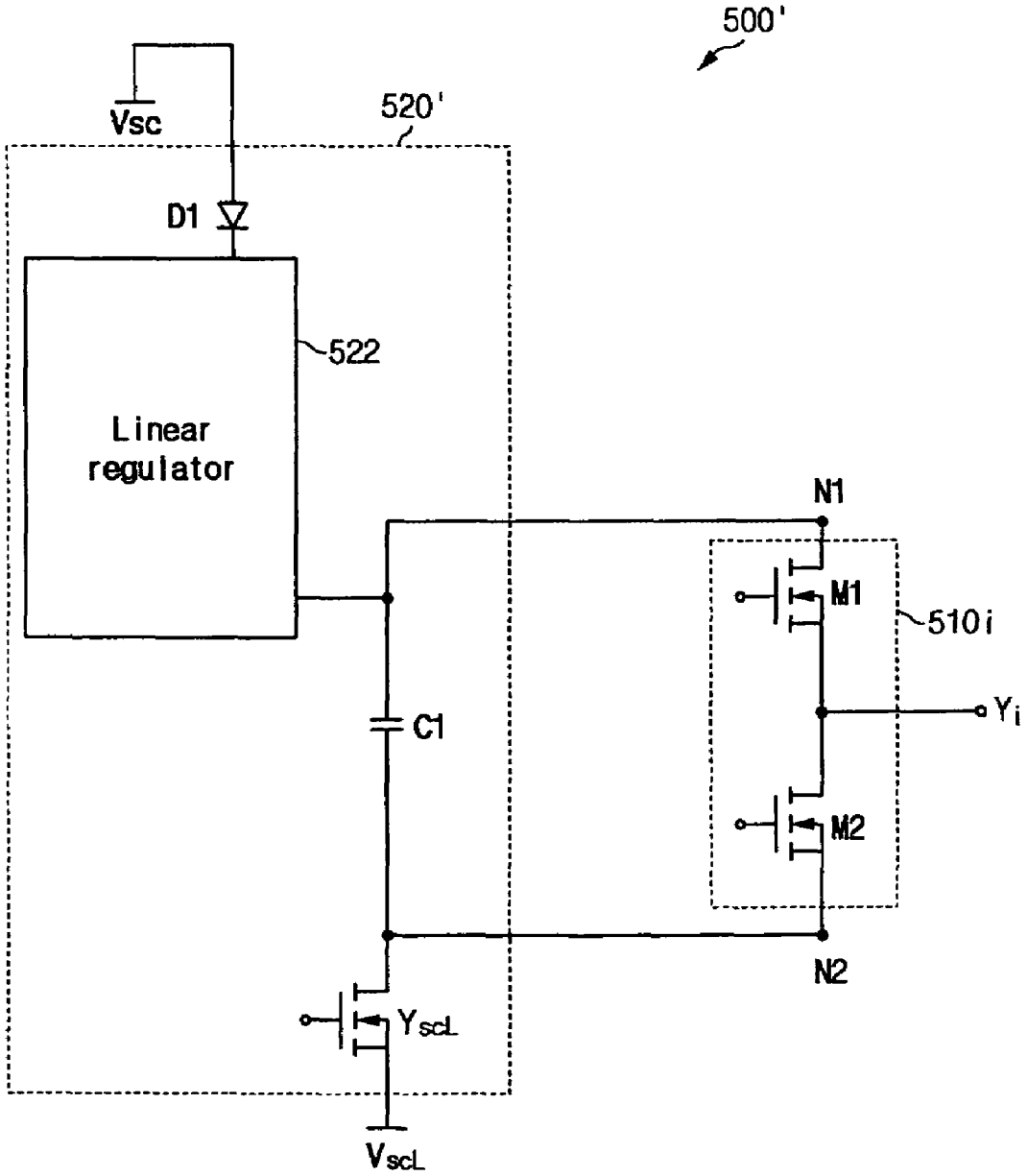

FIG. 6 is a circuit diagram of a Y electrode driver 500' according to a third exemplary embodiment of the present invention.

As shown in FIG. 6, a scan driving circuit 520' of the Y electrode driver 500' according to the third exemplary embodiment generates the voltage $V_{scH}$ by using a linear regulator 522.

In detail, the linear regulator 522 is coupled between the first terminal N1, i.e., the first node N1 of the scan circuit $\mathbf{510}_i$, and the voltage source $V_{sc}$. In addition, a diode D1 can be coupled between the voltage source $V_{sc}$ and the linear regulator 522 to block a current path which is formed from the linear regulator 522 to the voltage source $V_{sc}$. The linear regulator 522 lowers the voltage $V_{sc}$ and outputs the voltage $V_{scH}$ when the voltage of the first terminal N1 of the capacitor C1 is lower than the voltage $V_{sc}$.

Figure 7:
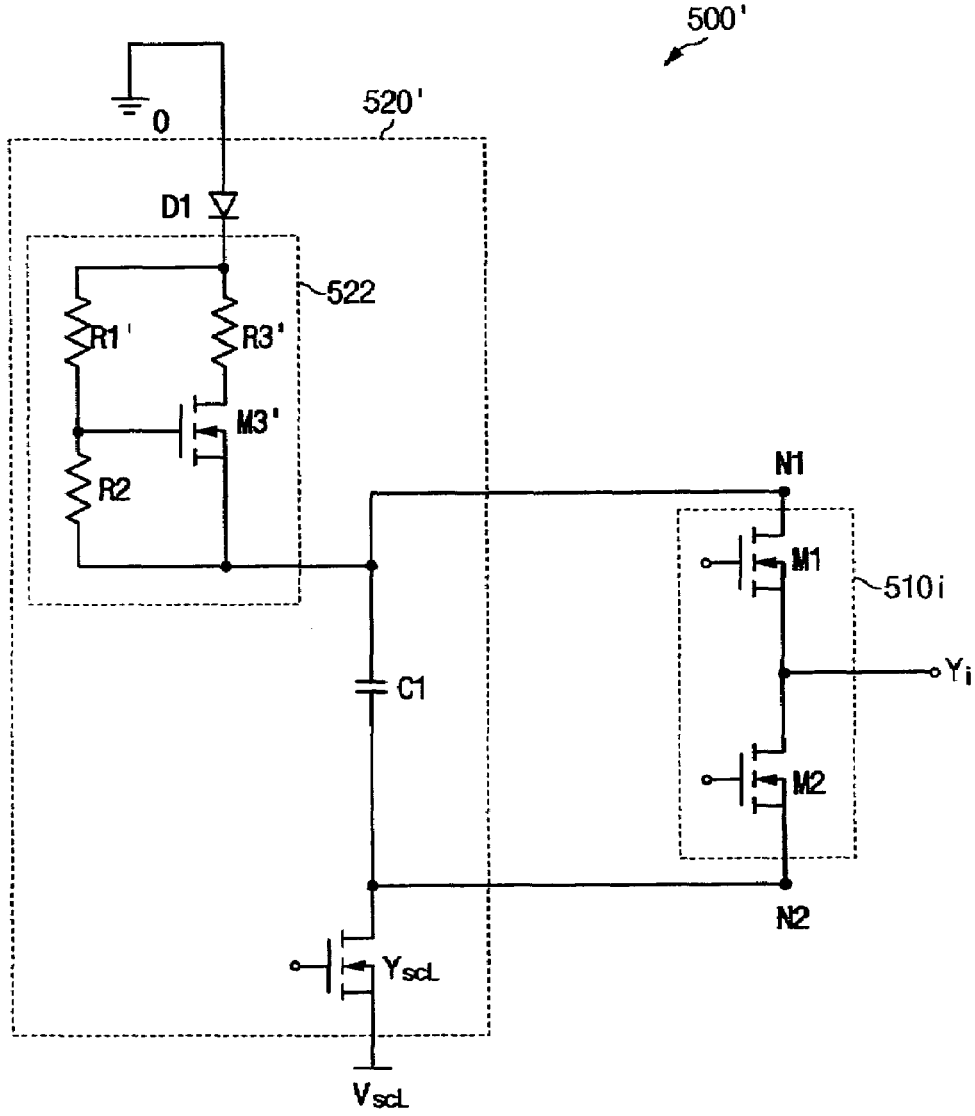
Figure 8:
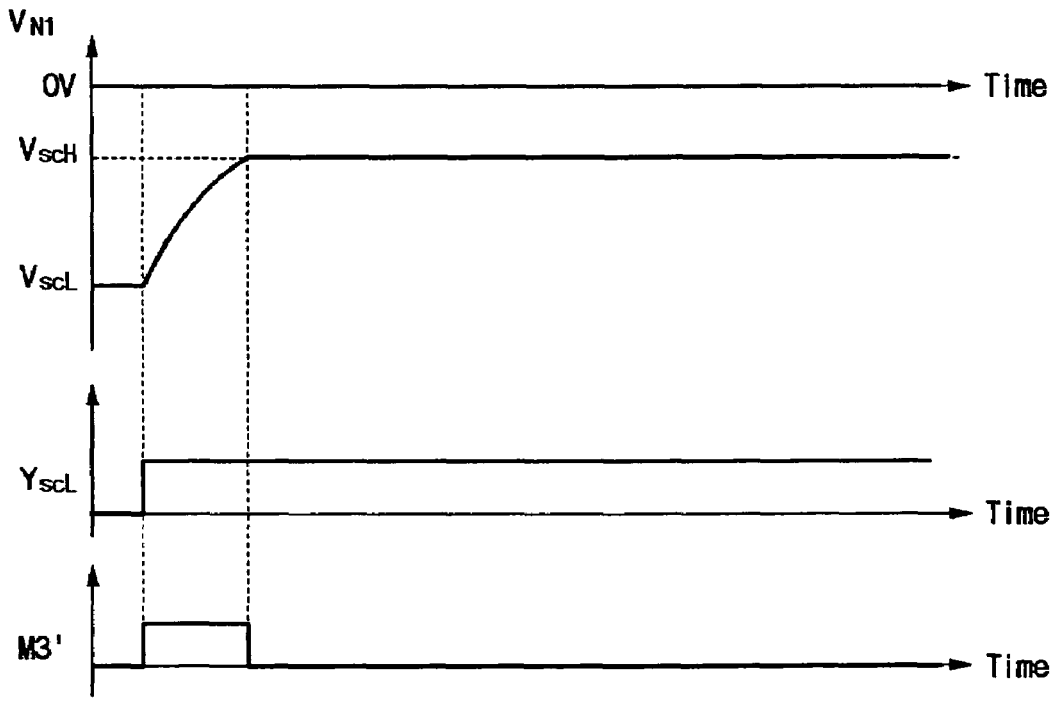

FIG. 7 is a circuit diagram of a Y electrode driver 500' according to a fourth exemplary embodiment, and FIG. 8 are waveforms of the driving circuit of FIG. 7. A ground terminal 0 is used as the voltage source $V_{sc}$ in FIG. 7.

As shown in FIG. 7, a linear regulator 522' includes resistors R1' and R2', and a transistor M3'. A source of the transistor M3' is coupled to the first terminal of N1 of the capacitor C1, and a drain of the transistor M3' is coupled to the ground terminal 0. The resistor R1' is coupled between a gate of the transistor M3' and the drain of the transistor M3', and the resistor R2' is coupled between the source of the transistor M3 and the gate of the transistor M3. In addition, a resistor R3' can be coupled between the ground terminal 0 and the drain of the transistor M3 to limit current flowing from the drain of the transistor M3' to the source of the transistor M3'.

Referring to FIG. 8, firstly, the transistor $Y_{scL}$ is turned on during the address period such that a voltage of the second terminal N2 of the capacitor C1 becomes the voltage $V_{scL}$. In addition, a voltage that is divided by the resistors R1' and R2' becomes a source voltage of the transistor M3' of the regulator 522 since a voltage of the first terminal N1 of the capacitor C1 is the voltage $V_{scL}$ if a voltage has not been charged to the capacitor C1. Therefore, a gate-source voltage Vgs' of the transistor M3' is given by Equation 5. Then, the transistor M3' is turned on by the positive gate-source voltage Vgs' since the transistor M3' is the n-channel transistor. As a result, the capacitor C1 is charged through a path of the ground terminal 0, the diode D1, the resistor R3', the transistor M3', the capacitor C1, the transistor $Y_{scL}$, and the voltage source $V_{scL}$.

Equation 5:

$$Vgs' = \frac{R2}{R1 + R2}|VscL|$$

When the capacitor C1 is charged such that the gate-source voltage Vgs' of the transistor M3' is less than a threshold voltage $V_{TH}'$ of the transistor M3' as expressed in Equation 6, the transistor M3' is turned off. As a result, the voltage $V_{N1}$ of the first terminal N1 of the capacitor C1 is given in Equation 7, and this voltage $V_{N1}$ becomes the voltage $V_{scH}$. If the voltage $V_{N1}$ of the first terminal N1 of the capacitor C1 is lowered by discharge of the capacitor C1, the transistor M3' is turned on again. Therefore, a voltage charged to the capacitor C1 can be maintained at a desired voltage during the address period in which the transistor $Y_{scL}$ is turned on.

Equation 6:

$$Vgs = \frac{R2}{R1 + R2}|V_{N1}| - < V_{TH}$$

Equation 7:

$$V_{N1} = VscL - V_{TH}\left(1 + \frac{R1}{R2}\right)$$

A time in which the capacitor C1 is charged can be determined by controlling a magnitude of the resistor R3'. In addition, a magnitude of the voltage $V_{scH}$ can be determined by having at least one of the resistors R1' and R2' be a variable resistor and controlling a magnitude of the variable resistor.

While the first to fourth exemplary embodiments have been described to set the voltage $V_{scH}$ to a negative voltage, the voltage $V_{scH}$ CAN be set to a positive voltage by setting a voltage supplied from the voltage source $V_{sc}$ to a positive voltage. A voltage source supplying the voltage $V_a$, $V_e$, or $V_s$ of FIG. 2 can be used as this voltage source $V_{sc}$.

As described above, according to the exemplary embodiments of the present invention, the voltage $V_{scH}$ can be generated by using a voltage generator such as the voltage divider and the linear regulator, the voltage source $V_{sc}$ (the ground terminal 0), and the voltage source $V_{scL}$. The voltage generator generates the voltage $V_{scH}$ by controlling the source voltage of the transistor M3 or M3' by using the voltage charged to the capacitor C1. Therefore, the voltage $V_{scH}$ can be supplied to the Y electrodes during the address period without requiring a separate voltage source for supplying the voltage $V_{scH}$.

While the present invention has been described in connection with what is presently considered to be practical exemplary embodiments, it is to be understood that the present invention is not limited to the disclosed embodiments, but rather is intended to cover various modifications and equivalent arrangements included within the spirit and scope of the appended claims.

What is claimed is:

1. A plasma display, comprising:
- a plurality of scan electrodes;
- a plurality of scan circuits respectively coupled to the plurality of scan electrodes, each scan circuit adapted to selectively supply a voltage of a first node and a voltage of a second node to a corresponding scan electrode of the plurality of scan electrodes;
- a capacitor coupled between the first node and the second node;
- a first transistor coupled between the second node and a first voltage source adapted to supply a first voltage;
- a second transistor coupled between a second voltage source adapted to supply a second voltage and the first node, and having a source whose voltage is determined by the first node;
- a first resistor coupled between the second voltage source and a gate of the second transistor; and
- a second resistor coupled to the gate of the second transistor, and adapted to divide the second voltage together with the first resistor.

2. The plasma display of claim 1, wherein the second resistor is coupled between the gate of the second transistor and a third voltage source.

3. The plasma display of claim 2, wherein the third voltage source includes the first voltage source.

4. The plasma display of claim 1, wherein the second resistor is coupled between the gate of the second transistor and the source of the second transistor.

5. The plasma display of claim 1, wherein the second transistor comprises an n-channel transistor, and wherein the second voltage is higher than the first voltage.

6. The plasma display of claim 5, wherein the first voltage comprises a negative voltage, and wherein the second voltage comprises a ground voltage.

7. The plasma display of claim 1, wherein at least one of the first resistor and the second resistor comprises a variable resistor.

8. The plasma display of claim 1, further comprising a diode and a third resistor coupled in series between the second voltage source and a drain of the second transistor; wherein the first resistor is coupled between a contact point of the diode and the third resistor and the gate of the second transistor.

9. The plasma display of claim 1, wherein each scan circuit comprises:
- a third transistor coupled between the first node and the corresponding scan electrode; and
- a fourth transistor coupled between the corresponding scan electrode and the second node.

10. The plasma display of claim 9, wherein the first transistor is turned on, the fourth transistors of the plurality of scan circuits are selectively turned on, and the third transistors of scan circuits having the turned-off fourth transistors are turned on during the address period.

11. The plasma display of claim 9, wherein at least part of the plurality of scan circuits comprise an integrated circuit.

12. A method of driving a plasma display including a plurality of scan electrodes, a plurality of scan circuits respectively coupled to the plurality of scan electrodes, and a capacitor coupled between a first terminal and a second terminal, each scan circuit selectively supplying a voltage of the first terminal and a voltage of the second terminal to a corresponding scan electrode of the plurality of scan electrodes, the driving method comprising:

supplying a first voltage to the second terminal;

supplying a second voltage that is higher than the first voltage to the first terminal to charge the capacitor;

electrically isolating the second voltage from the capacitor upon the capacitor being charged such that a voltage of the first terminal is a third voltage that is different from the second voltage; and selectively supplying the third voltage and the first voltage to the plurality of scan electrodes through the first terminals and the second terminals of the plurality of scan circuits.

13. The method of claim 12, wherein the second voltage is higher than the third voltage.

14. The method of claim 13, wherein the first voltage comprises a negative voltage, and the second voltage comprises a ground voltage.

15. The method of claim 12, wherein supplying the third voltage and the first voltage to the plurality of scan electrodes comprises:

sequentially supplying the first voltage to the plurality of scan electrodes; and supplying the third voltage to those scan electrodes which the first voltage have not been supplied.

16. The method of claim 12, wherein:

supplying the first voltage to the second terminal comprises supplying a voltage that is divided between a fourth voltage corresponding to the second voltage and the first voltage to a gate of a transistor having a source coupled to the first terminal;

supplying the second voltage to the first terminal comprises turning on the transistor; and electrically isolating the second voltage from the capacitor comprises turning off the transistor.

17. The method of claim 12, wherein:

supplying the first voltage to the second terminal comprises supplying a voltage that is divided between a fourth voltage corresponding to the second voltage and a voltage of the first terminal to a gate of a transistor having a source coupled to the first terminal;

supplying the second voltage to the first terminal comprises turning on the transistor; and electrically isolating the second voltage from the capacitor comprises turning off the transistor.

18. A plasma display driver for a plasma display including a plurality of scan electrodes and a plurality of scan circuits respectively coupled to the plurality of scan electrodes, each scan circuit selectively supplying a voltage of a first terminal and a voltage of a second terminal to a corresponding scan electrode of the plurality of scan electrodes, the plasma display driver comprising:

a capacitor coupled between the first terminal and the second terminal;

a first transistor coupled between the second terminal and a first voltage source adapted to supply a first voltage; and a voltage divider coupled between the first voltage source and a second voltage source adapted to supply a second voltage, and to output a third voltage that is lower than the second voltage to the first terminal.

19. The plasma display driver of claim 18, wherein the voltage divider comprises:

a second transistor having a source coupled to the first terminal and a drain coupled to the second voltage source;

a first resistor coupled between a gate of the second transistor and the drain of the second transistor; and a second resistor coupled between the gate of the second transistor and a source of the first transistor.

20. The plasma display driver of claim 18, wherein the first transistor is adapted to be turned on during an address period.

21. The plasma display driver of claim 20, wherein the first voltage comprises a negative voltage, and the second voltage comprises a ground voltage.

22. A plasma display driver for a plasma display including a plurality of scan electrodes and a plurality of scan circuits respectively coupled to the plurality of scan electrodes, each scan circuit selectively supplying a voltage of a first terminal and a voltage of a second terminal to a corresponding scan electrode of the plurality of scan electrodes, the plasma display driver comprising:

a capacitor coupled between the first terminal and the second terminal;

a first transistor coupled between the second terminal and a first voltage source adapted to supply a first voltage; and a linear regulator coupled between the first terminal and a second voltage source adapted to supply a second voltage, and to output a third voltage that is lower than the second voltage to the first terminal.

23. The plasma display driver of claim 22, wherein the linear regulator comprises:

a second transistor having a source coupled to the first terminal and a drain coupled to the second voltage source;

a first resistor coupled between a gate of the second transistor and the drain of the second transistor; and a second resistor coupled between the gate of the second transistor and the source of the second transistor.

24. The plasma display driver of claim 23, wherein the first transistor is adapted to be turned on during an address period.

25. The plasma display driver claim 24, wherein the first voltage comprises a negative voltage, and the second voltage comprises a ground voltage.

* * * * *